US006406281B1

(12) United States Patent
Aggradi et al.

(10) Patent No.: US 6,406,281 B1
(45) Date of Patent: Jun. 18, 2002

(54) SCREW-TYPE PUMPING UNIT FOR TREATMENT OF FLUIDS IN SEVERAL PHASES

(75) Inventors: Gianpietro Ferrari Aggradi, Florence; Vasco Mezzedimi, Poggibonsi; Corrado Palarchi, Florence, all of (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 09/662,638

(22) Filed: Sep. 15, 2000

(30) Foreign Application Priority Data

Sep. 23, 1999 (IT) ..... MI99A1978

(51) Int. Cl.[7] ..... F03C 2/00
(52) U.S. Cl. ..... 418/88; 418/201.1; 418/202
(58) Field of Search ..... 418/88, 201.1, 418/202

(56) References Cited

U.S. PATENT DOCUMENTS

| | | | | |
|---|---|---|---|---|
| 2,498,972 A | * | 2/1950 | Whiteley | 418/88 |
| 2,931,310 A | | 4/1960 | Musser | |
| 2,937,807 A | * | 5/1960 | Lorenz | 418/88 |
| 2,940,661 A | * | 6/1960 | Lorenz | 418/88 |
| 3,146,717 A | | 9/1964 | Tyree, Jr. | |
| 5,028,220 A | * | 7/1991 | Holdsworth | 418/88 |

FOREIGN PATENT DOCUMENTS

| | | | | |
|---|---|---|---|---|
| JP | 55-023365 | * | 2/1980 | 418/201.1 |
| JP | 62051724 | | 3/1987 | |
| JP | 03-233136 | * | 10/1991 | 418/201.1 |

* cited by examiner

*Primary Examiner*—Thomas Denion
*Assistant Examiner*—Theresa Trieu
(74) *Attorney, Agent, or Firm*—Nixon & Vanderhye

(57) ABSTRACT

A screw-type pumping unit (51) for treatment of fluids in several phases comprises a case (54) which contains a pumping chamber (62), inside which there are accommodated at least two screws (70*a*, 70*b*), one of which (70*a*) is a drive screw, and supports at one of its ends a first gear (108*a*), which engages with a second gear (108*b*), which in turn is supported at one end of a driven screw (70*b*). The first and the second gear (108*a*, 108*b*) are contained in a casing (110) which is fitted onto them, and is provided with at least two through holes (112, 114) produced in two substantially opposite portions, through one of which oil can be admitted into the casing (110), and wherein the oil can be discharged through the other through hole (114), such that the casing (110), together with the gears (108*a*, 108*b*), forms a gear pump which can keep the lubrication oil of the pumping unit (51) circulating.

7 Claims, 5 Drawing Sheets

SCREW-TYPE PUMPING UNIT FOR TREATMENT OF FLUIDS IN SEVERAL PHASES

BACKGROUND OF THE INVENTION

The present invention relates to a screw-type pumping unit for treatment of fluids in several phases.

In particular, in this case, reference is made to a screw-type pumping unit which can be used in the exploitation of oil fields, and which must therefore be able to treat simultaneously multi-phase mixtures consisting in particular of crude oil in the liquid phase, and its accompanying gases.

A problem which is applicable in particular consists of the fact that the oil fields which are known at present are not all exploited. In fact, only the fields which are economically viable and have a certain size, combined with quality products, are actually exploited, and the other fields which are not economically viable are considered as "marginal fields".

The marginal fields are usually located in inconvenient areas on land, or, increasingly frequently, they are in undersea areas, in waters of medium depths.

The development of the marginal fields is considered to be one of the determining factors in the international oil industry in the near future. This aspect is applicable in particular in the case of undersea fields, since at present, oil research is being carried out specifically in this respect.

On this understanding, particular reference will be made hereinafter to a pumping unit which can be used for extraction of crude oil from underground fields.

However, it should be understood that the present invention can be used in other, different applications, such as also in an oil field on land, in a particularly inconvenient environment.

In order to assist understanding of the present invention, it should be noted that the conventional techniques of extraction of crude oil from an oil field require that the fluid extracted from the wells is firstly separated in the vicinity of the head of the wells, into its liquid and gaseous components, which are subsequently conveyed by means of pipes or tankers to an oil processing centre. The oil processing centre is usually located on land or on a production rig, and therefore at a distance from the well which can actually be considerable.

It will be appreciated that this makes the process of extraction and subsequent treatment of the crude oil extremely costly, and means that, as already stated, many fields are considered as marginal fields, and are therefore not exploited owing to the high costs which this would involve.

However, in recent years, a new production technique has been developed, consisting of extraction and conveyance of the multi-phase mixture, as extracted from the wells, to the processing centres, where it is treated. This therefore provides a substantial decrease in costs, which makes many fields which were previously considered marginal economically viable.

In order to implement the production technique described, pumping units have been developed which can carry out simultaneously both the service of thrusting the liquids, and compressing the gases.

In order to make apparent the technical problems which are inherent in simultaneous pumping and compression of a liquid and a gas in the same machine, a brief description is provided hereinafter of a portion of a typical conventional pumping unit for multi-phase mixtures, with reference to FIG. 1, wherein the unit as a whole is indicated by the reference number 11.

The unit 11 is designed for pumping of multi-phase mixtures for undersea applications in a vertical configuration.

The pumping unit 11 is of the screw type, and consists of a case 12, in which there are accommodated two screws 14 which engage with one another.

Each of the screws 14 is provided with a cylindrical extension 16, which extends inside a housing 18. In this configuration, the housing 18, which acts as a support, also acts as a tank for the lubrication oil. The extensions 16 are provided with seals 20 and radial axial support bearings 22, which are connected to a thrust bearing 24.

At the end of each extension 16, there is provided a gear 26, which synchronises the motion of the two screws 14. Each of the cylindrical extensions 16 rotates a lubrication pump 30, by means of a coupling 28. There are two pumps 30, in order to guarantee the reliability of the pumping unit 11.

The pumps 30 suck up the oil contained in the housing 18, and keep it circulating in a corresponding lubrication circuit, which is not shown for the sake of simplicity. The lubrication circuit has a connection 32 for delivery to an exchanger (not shown), and a connection 34 for return from the seals and bearings which are disposed in the vicinity of the screws 14.

However, in some cases, these conventional pumping units are unreliable. This is caused mainly by the presence of the lubrication pumps 30, which, if they malfunction, put the entire pumping unit 11 out of use.

Another factor which can detract from the reliability of the pumping unit consists of the presence of the couplings 28, which are also elements which can be subject to faults or breakages.

It is apparent that the possibility of these disadvantages occurring must be limited as far as possible, since, owing to the undersea destination of the pumps, maintenance interventions on them cannot be carried out, or can be carried out only with considerable difficulty, and always at high costs.

It should also be noted that a fault of this type can involve the risk of stoppage of production.

SUMMARY OF THE INVENTION

The object of the present invention is to eliminate the technical disadvantages described, by providing a screw-type pumping unit for treatment of fluids in several phases, which is highly reliable, particularly in view of the use for which pumping units of this type are destined.

Another object of the invention is to provide a pumping unit which is substantially economical.

A further object of the invention is to provide a pumping unit for treatment of fluids in several phases, which is substantially simple and dependable.

This object and others, according to the present invention, are achieved by providing a screw-type pumping unit for treatment of fluids in several phases, comprising a pumping chamber, inside which there are accommodated at least two screws, wherein one of the said screws is a drive screw, and supports at one of its ends at least one first gear, which engages with at least one second gear, which is associated with a driven screw, wherein the connection to one another of the said screws permits pumping of a mixture of liquid and gas from at least one intake mouth to at least one outlet mouth, characterised in that the said first and the second gears are contained in a casing which is fitted onto them, and is provided with at least one first through hole, through which oil can be admitted into the said casing, and at least one second through hole, through which the oil can be discharged, such that the said casing, together with the said gears, forms a gear pump which can keep the lubrication oil of the pumping unit circulating.

According to a preferred embodiment, the pumping unit according to the present invention is provided with gears which have at least one transverse groove with two toothed portions, each of which is connected to the corresponding portion of the other gear.

According to another embodiment, the pumping unit according to the present invention is provided with a seal, which is accommodated inside the transverse grooves of the gears. These seals impede reflux of the oil, from one area inside the casing which has high pressure, to another which has a lower pressure.

Further characteristics of the invention are defined in the claims attached to the present patent application.

It should thus be noted that the specific feature of the invention consists of having created a compact structure for accommodation and functioning of the system which permits pumping of the oil destined for lubrication of the machine.

By this means it is possible, inter alia, to eliminate oil pumping components, such as lubrication pumps and corresponding seals, thus permitting elimination of components which were previously critical for the reliability of the system as a whole.

Further characteristics and advantages of a pumping unit for treatment of fluids in several phases according to the present invention, will become more apparent from the following description, provided by way of non-limiting example, with reference to the attached schematic drawings, in which:

BRIEF DESCRIPTION OF THE DRAWING FIGURES

DETAILED DESCRIPTION OF A PREFERRED EMBODIMENT

Figure 1:
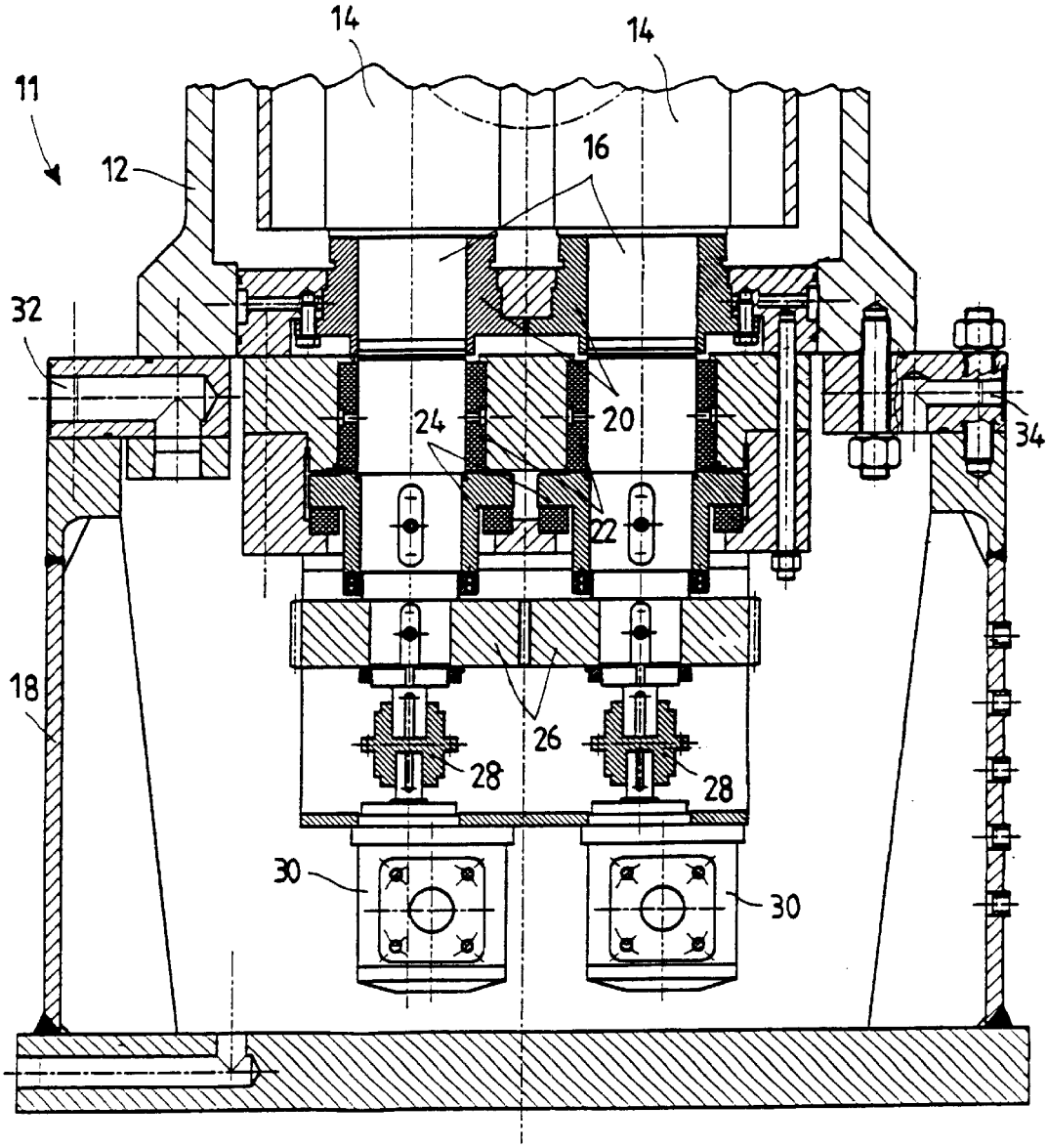
Fig.1 PRIOR ART
FIG. 1 shows a longitudinal cross-section of a screw-type pumping unit for treatment of fluids in several phases, according to the known art.
Figure 2:
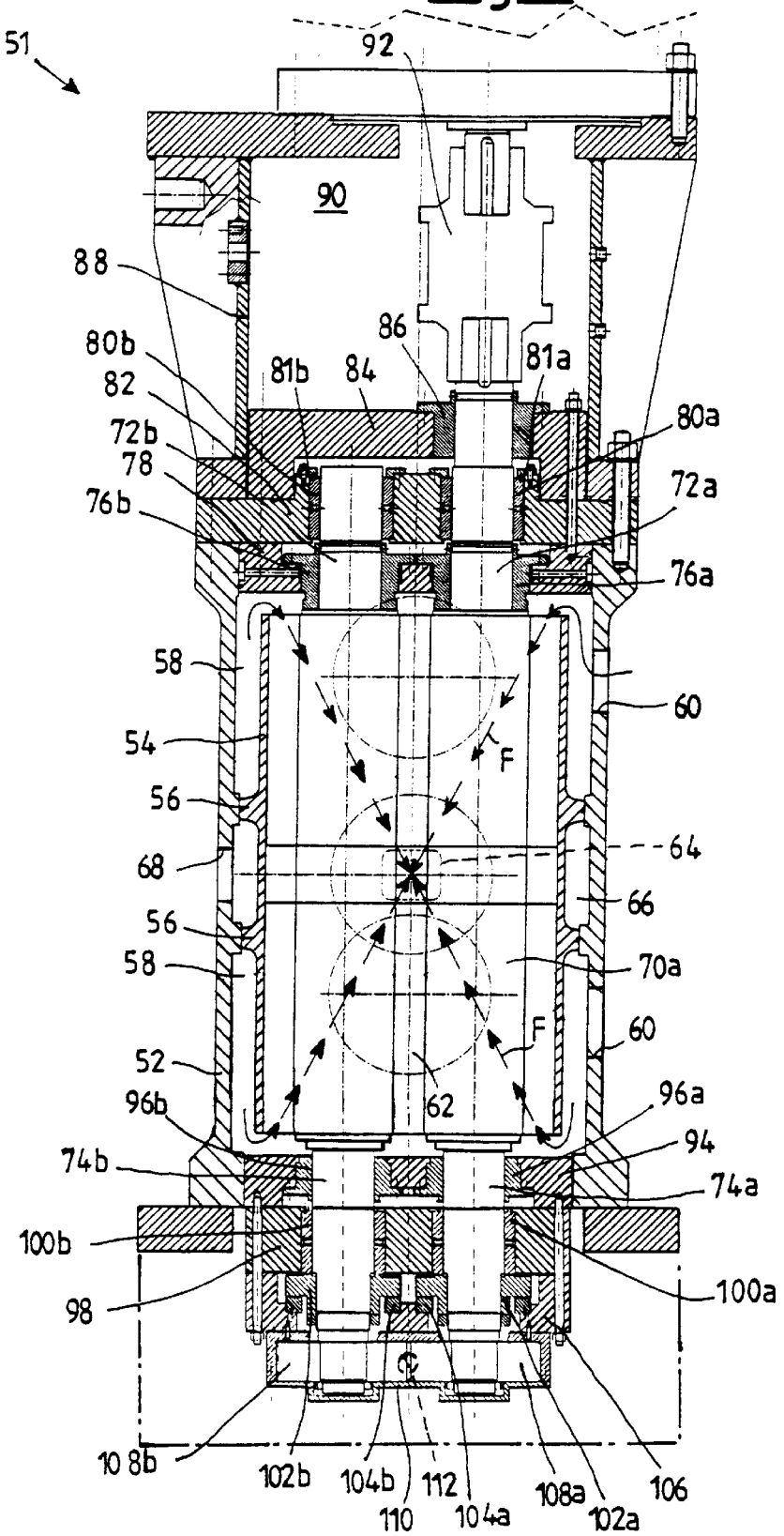
FIG. 2 shows a longitudinal cross-section of a pumping unit according to the present invention.
Figure 3:
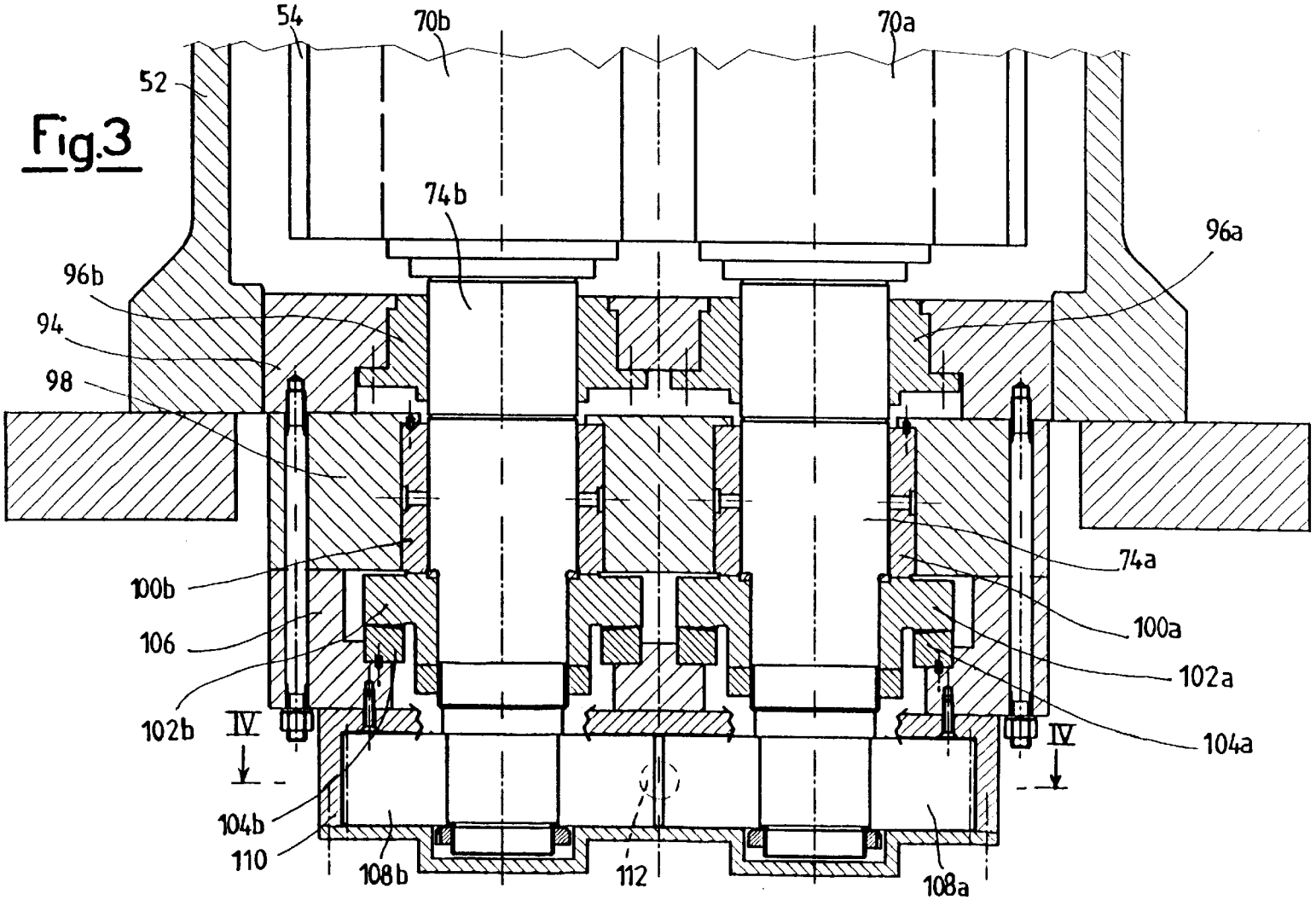
FIG. 3 shows a longitudinal cross-section of a detail of the pumping unit shown in FIG. 2.
Figure 4:
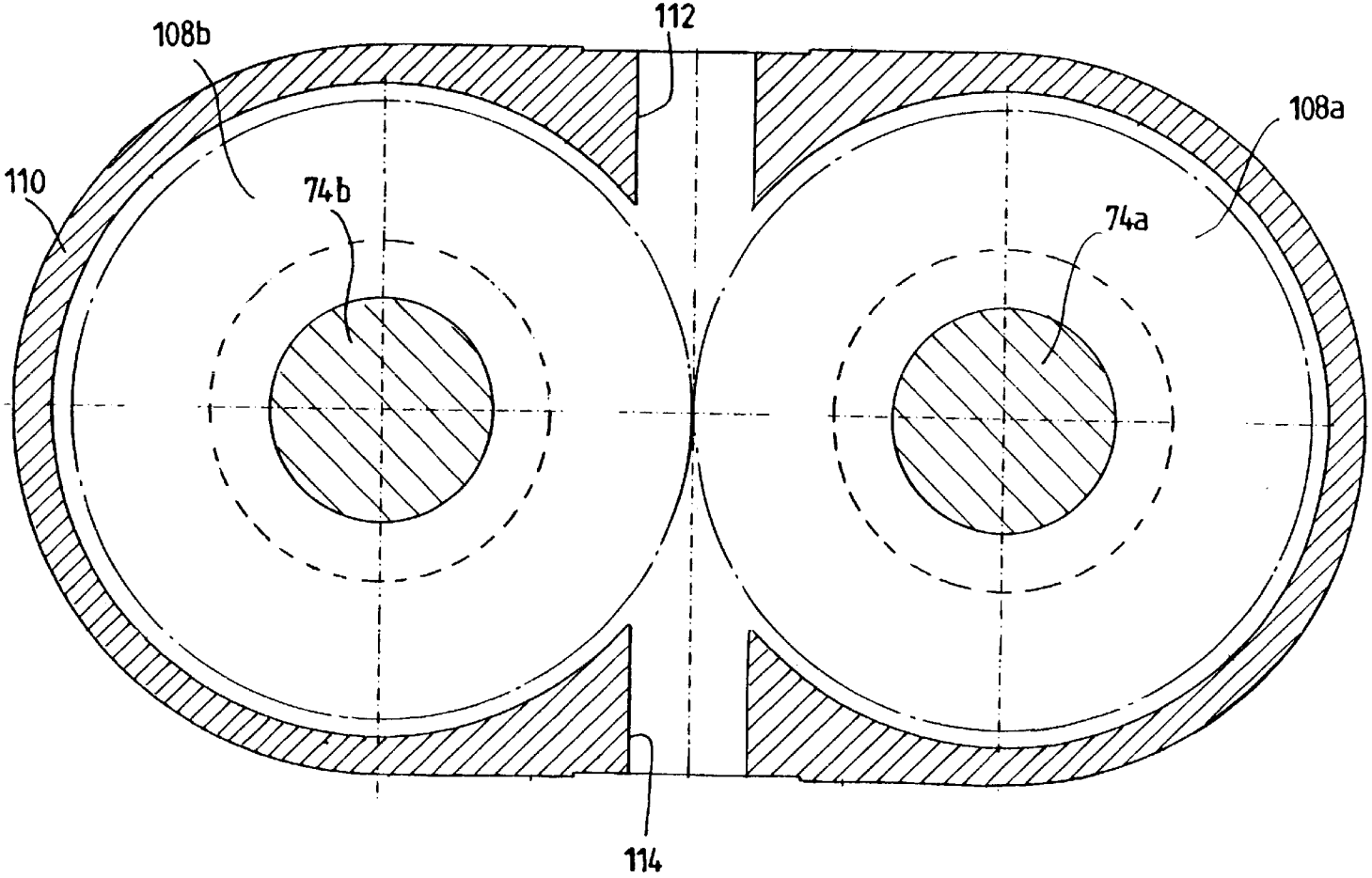
FIG. 4 shows an enlarged cross-section, produced along line IV—IV in FIG. 3.

The aforementioned figures show a pumping unit for treatment of fluids in several phases, indicated as a whole by the reference number 51.

The pumping unit 51 comprises an outer case 52, inside which there is provided an inner case 54, which is connected to the outer case 52 by means of two annular flanges 56.

The inner case 54, together with the flanges 56, forms four chambers which are connected to one another.

Two lateral supply chambers 58 are annular, and are contained between the case 52 and the case 54. Each of the latter is provided with an intake mouth 60, through which a mixture consisting of liquid and gas can enter into the chambers 58.

The chamber 58 communicates with a pumping chamber 62 inside the case 54, and is connected by means of a central through hole 64 to a delivery chamber 66, which is central and is also annular.

The chamber 66, which in turn is provided with an outlet mouth 68 through which, after having been treated by the pumping unit 51, the mixture is conveyed to a delivery pipe (not shown).

Inside the chamber 62 there are accommodated a drive screw 70*a* and a driven screw 70*b*. Each of the screws 70*a*, 70*b* has two portions which extend from each of the two ends towards the centre, have a helical thread oriented in directions opposite to one another, and engage with a corresponding thread in the other screw 70*b*, 70*a*. By this means, when the pumping unit 51 is functioning, the axial stresses on the screws 70*a*, 70*b* are compensated, and the resulting axial stress is very limited or zero.

The two screws 70*a*, 70*b* extend substantially along the entire length of the chamber 62, and have at their own ends cylindrical portions 72*a*, 72*b*, 74*a*, 74*b*, by means of which they are supported and rotated.

The portions 72*a*, 72*b* are inserted, with seals 76*a*, 76*b* interposed, each in a through hole in a first plate 78, which closes one end of the case 52. The same ends 72*a*, 72*b* are also supported by bearings 80*a*, 80*b*, which are inserted in through holes in a second plate 82, which is integral with the case 52 and with the first plate 78. The bearings 80*a*, 80*b* are of the radial axial type, and are connected to a ring 81*a*, 81*b* which locks their translation in an axial direction.

There is integral with the second plate 82 a third plate 84, which is provided with a through hole, through which the portion 72*a* passes, with a further seal 86 interposed. There is integral with the plate 84 a housing 88, which forms a chamber 90. The chamber 90 accommodates a coupling 92, which is connected firstly to an electric motor (which is not shown for the sake of simplicity), and secondly to the portion 72*a* of the drivescrew. The electric motor is usually supplied by means of an electric cable (not shown), obtained from a fixed station on land or on a rig.

On the opposite side, the case 52 is closed by means of a plate 94, which is provided with through holes, through which the portions 74*a*, 74*b* of the screws 70*a*, 70*b* pass, with seals 96*a*, 96*b* interposed.

There is integral with the plate 94 a further plate 98, which is also provided with two through holes, in which two bearings 100*a*, 100*b* are provided. The bearings 100*a*, 100*b* are also of the radial axial type, and are each connected to a thrust bearing 102*a*, 102*b* inserted on the portions 74*a*, 74*b*, which prevent translations in an axial direction of the screws 70*a*, 70*b*. In fact, each of the thrust bearings 102*a*, 102*b* is provided with a flange, against which there is placed a thrust bearing 104*a*, 104*b*, which is supported by another plate 106, which has an edge folded such as to form a shoulder for the bearings 104*a*, 104*b*.

On the end of each of the portions 74*a*, 74*b*, there are keyed gears 108*a*, 108*b*, which engage with one another. The gears 108*a*, 108*b* are contained inside a casing 110, which is integral with the plate 106. The casing 110 consists of a box-type body 110*a*, which is closed by means of a cover 110*b*.

The gear 108*a*, which is keyed onto the portion 74*a* of the drive screw 70*a*, transmits motion to the gear 108*b*, and therefore rotates the driven screw 70*b,* in phase with the drive screw 70*a.*

In addition, the casing 110 is provided with two through holes 112, 114, which are produced in its opposite sides and are symmetrical, through which the lubrication oil for all the elements of the pumping unit 51 can be admitted or output. By this means, the casing 110, together with the gears 108*a,* 108*b,* constitutes a gear pump which is actuated by the electric motor of the pumping unit 51.

The pumping unit 51 for treatment of fluids in several phases according to the present invention functions substantially as follows.

The pumping unit 51 is usually installed in a vertical position, with the electric motor disposed at the top part.

The mixture to be treated enters the chamber 58 via the mouths 60. From there, it passes into the pumping chamber 62, in the vicinity of the ends of the two screws 70*a,* 70*b.* In the chamber 62, guided by the screws 70*a* and 70*b,* the mixture follows a path similar to that indicated by the arrows F, and, by passing through the hole 64, enters into the delivery chamber 66. From the chamber 66, the fluid passes to the delivery pipe (not shown), via the mouth 68.

The screws 70*a,* 70*b* are rotated by the electric motor. In fact, the electric motor rotates the drive screw 70*a*. This in turn rotates the screw 70*b,* via the connected gears 108*a,* 108*b,* which guarantee movement in phase of the screws.

At the same time, the gears 108*a* and 108*b* pressurise the lubrication oil, which is conveyed into the lubrication circuit, thus acting as a gear pump.

Figure 5:
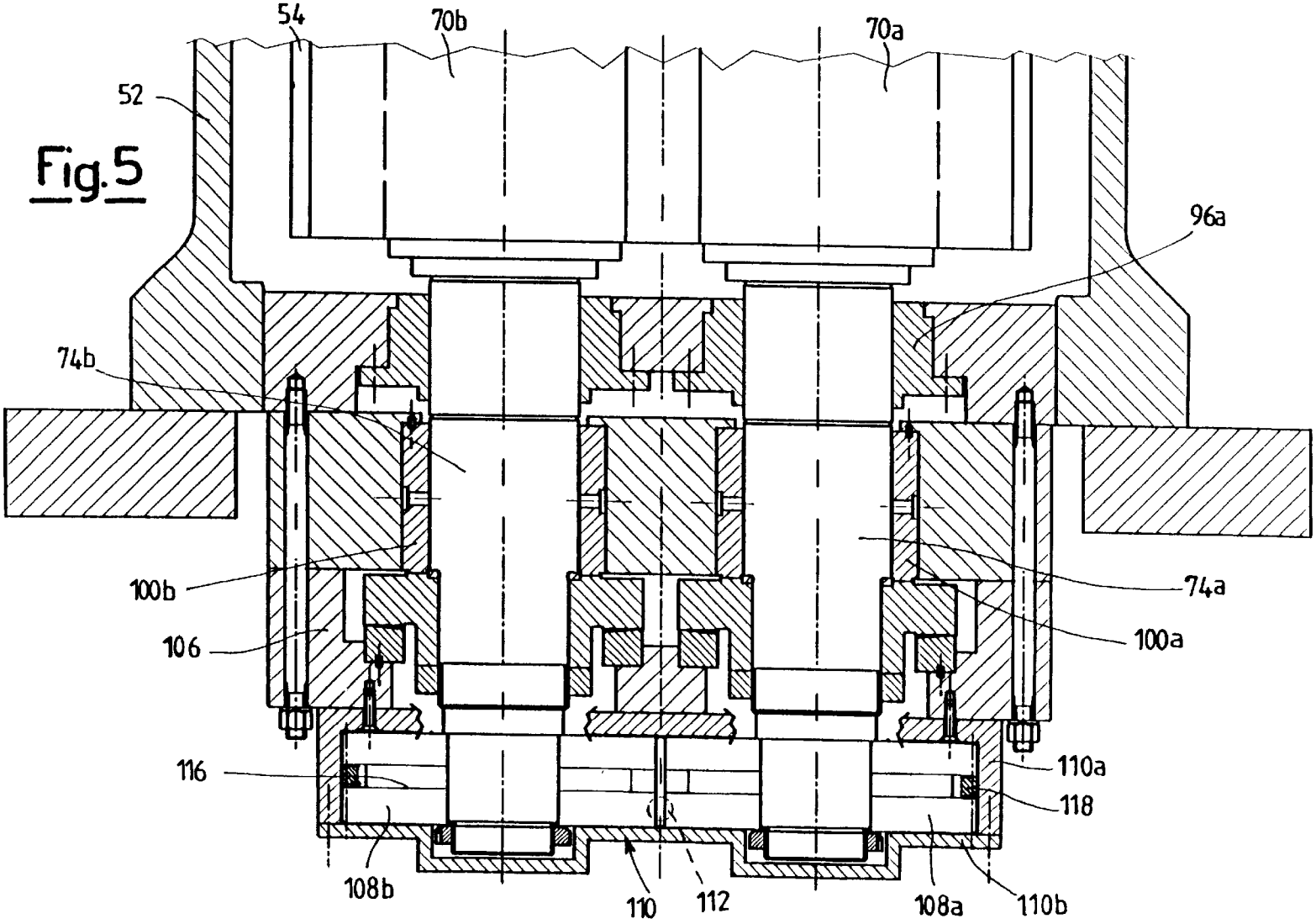
FIG. 5 shows a longitudinal cross-section of a different embodiment of the detail of the pumping unit according to the invention, shown in FIG. 3.

A different embodiment of the pumping unit for processing of fluids in several phases according to the present invention, is shown in FIG. 5, in which the same reference numbers indicate elements which are the same or similar.

In the embodiment shown in FIG. 5, the gears 108*a* and 108*b* are provided with a transverse groove 116 which separates in each of the two gears 108*a,* 108*b* two toothed portions, each of which is connected to the corresponding portion of the other gear 108*b,* 108*a.*

In the embodiment in FIG. 5, the groove 116 is positioned centrally on the gears 108*a,* 108*b,* but it will be appreciated that in other embodiments, the groove 116 can be provided in the vicinity of one of the ends of the gears, such that the pump constituted by the gears 108*a,* 108*b* together with the casing 110 can supply the required flow rate of oil.

It will be appreciated that the casing 110 is provided with the through holes 112, 114, which however in this embodiment are positioned at the toothed portions connected to one another, which face the casing 110.

By this means, only a portion of the gears 108*a,* 108*b,* i.e. that which is adjacent to the casing 110, together with the casing 110 itself, constitutes the gear pump for lubrication of the elements of the pumping unit according to the present invention. By this means it is possible to limit the flow rate of the oil circulating in the lubrication circuit of the pumping unit 51.

According to a preferred embodiment, inside the grooves 116 of the gears 108*a,* 108*b,* there is provided a seal 118, which impedes reflux of the oil from one highpressure area inside the casing 110, to another area with a lower pressure.

It has been found in practice that the screw-type pumping unit for treatment of fluids in several phases according to the invention, is particularly advantageous, owing to the increased reliability provided by the elimination of components, such as lubrication pumps and corresponding couplings.

These properties thus permit dependable use and a long service life of the pumping unit described, in the most varied and demanding environments, ranging from undersea to on land.

The screw-type pumping unit for treatment of fluids in several phases thus designed can be subjected to many further modifications and variants, all of which come within the scope of the invention; in addition, all the details can be replaced by technically equivalent elements.

In practice, any materials and dimensions can be used, according to the technical requirements.

What is claimed is:

1. Screw-type pumping unit for treatment of fluids in several phases, comprising a pumping chamber, inside which there are accommodated at least two screws, wherein one of the said screws is a drive screw, and supports at one of its ends at least one first gear, which engages with at least one second gear, which is associated with a driven screw, wherein the connection to one another of the said screws permits pumping of a mixture of liquid and gas from at least one intake mouth to at least one outlet mouth, said first and second gears being contained in a casing which is fitted onto them, and is provided. with at least one first through hole, through which oil is admitted into the said casing, and at least one second through hole, through which the lubrication oil can be discharged, such that the said casing, together with the said gears, forms a gear pump which can keep the lubrication oil of the said pumping unit circulating, said pumping chamber further comprising an outer case, which accommodates an inner case, which is connected to the said outer case by means of flanges between the said inner case and the said outer case, at least one supply chamber being formed, into which the said mixture can enter via said at least one intake mouth, the said at least one supply chamber being connected to the said pumping chamber inside the said inner case, the latter being connected in turn by means of at least one through hole to at least one delivery chamber, which is provided with said at least one outlet mouth through which, after having been treated by the said pumping unit, the said mixture is conveyed to a delivery pipe.

2. Pumping unit according to claim 1, wherein said screws extend substantially along the entire length of the said pumping chamber, and at their own ends have cylindrical portions by means of which they are supported and rotated.

3. Pumping unit according to claim 1, wherein said through holes are provided in opposite portions of the said casing.

4. Pumping unit according to claim 1, wherein said gears are provided with at least one transverse groove, which separates two toothed portions, each of which is connected to the corresponding portion of the other gear.

5. Pumping unit according to claim 4, wherein the through holes through which the lubrication oil can be admitted or discharged, are positioned at toothed portions, which are connected to one another, of the said gears formed by the said transverse groove, which face the said casing, such that only these latter portions constitute the said gear pump.

6. Pumping unit according to claim 4, wherein inside the said transverse grooves of the said gears, there is provided at least one seal, which impedes reflux of the oil from a high-pressure area inside the said casing, to another area with a lower pressure.

7. Pumping unit according to claim 1, wherein said casing consists of a box-type body, which is closed by means of a cover.

* * * * *